US012687318B2

(12) United States Patent
Lee et al.

(10) Patent No.: US 12,687,318 B2
(45) Date of Patent: Jul. 21, 2026

(54) AIR PURIFIER WITH HUMIDIFICATION FUNCTION

(71) Applicant: Taiga Inc., Gwacheon-si (KR)

(72) Inventors: Won Seok Lee, Gwacheon-si (KR); Changhun Jeong, Anyang-si (KR)

(73) Assignee: Taiga Inc., Gwacheon-si (KR)

( * ) Notice: Subject to any disclaimer, the term of this patent is extended or adjusted under 35 U.S.C. 154(b) by 126 days.

(21) Appl. No.: 18/765,372

(22) Filed: Jul. 8, 2024

(65) Prior Publication Data

US 2024/0377099 A1 Nov. 14, 2024

(30) Foreign Application Priority Data

May 9, 2023 (KR) ..... 10-2023-0060117

(51) Int. Cl.

| | |
|---|---|
| ***F24F 13/20*** | (2006.01) |
| ***F24F 6/00*** | (2006.01) |
| ***F24F 6/12*** | (2006.01) |
| ***F24F 11/00*** | (2018.01) |

(52) U.S. Cl.

CPC ..... *F24F 13/20* (2013.01); *F24F 6/12* (2013.01); *F24F 11/0008* (2013.01); *F24F 2006/008* (2013.01)

(58) Field of Classification Search

CPC ..... F24F 13/20; F24F 6/12; F24F 11/0008; F24F 6/04; F24F 8/175; F24F 13/28; F24F 2140/00; F24F 11/61; F24F 2006/008

See application file for complete search history.

(56) References Cited

U.S. PATENT DOCUMENTS

2010/0133162 A1* 6/2010 Huang ..... F24F 6/12 210/206
2022/0307707 A1* 9/2022 Zhang ..... F24F 8/117

FOREIGN PATENT DOCUMENTS

| | | | | |
|---|---|---|---|---|
| CN | 106322610 A | * | 1/2017 | ..... F24F 6/12 |
| CN | 107469508 A | * | 12/2017 | ..... B01D 50/00 |
| CN | 110736168 A | * | 1/2020 | ..... F24F 5/0035 |
| CN | 110940073 A | * | 3/2020 | ..... F24F 6/12 |
| CN | 210292179 U | * | 4/2020 | ..... B05B 17/063 |
| CN | 112781136 A | * | 5/2021 | ..... F24H 3/0411 |
| JP | 7174584 B2 | * | 11/2022 | ..... F24F 3/16 |
| KR | 20050110233 A | | 11/2005 | |
| KR | 100770412 B1 | * | 10/2007 | ..... F24F 6/08 |
| KR | 20100109696 A | * | 10/2010 | ..... F24F 11/52 |

(Continued)

OTHER PUBLICATIONS

Korean Patent Office Written Opinion for Korean Application No. 10-2023-0060117 Issued on Nov. 8, 2024.

*Primary Examiner* — Kun Kai Ma

(74) *Attorney, Agent, or Firm* — ZION IP; Byungwoong Park

(57) ABSTRACT

An air purifier with a humidification function of the present disclosure has a first space in which a moss frame is installed, a second space in which a humidifier is installed, and a third space in which water vapor generated from the humidifier is discharged, and may allow air passing through moss to be sprayed indoors while being carried on the water vapor due to a pressure difference between the third space and the first space that is generated while the water vapor passes through the third space and is sprayed into the spray hole. In addition, the water vapor may also be supplied to the moss by selectively closing the spray hole.

12 Claims, 17 Drawing Sheets

(56) References Cited

FOREIGN PATENT DOCUMENTS

| | | | | | |
|---|---|---|---|---|---|
| KR | 20130011757 | A | | 1/2013 | |
| KR | 20130013098 | A | | 2/2013 | |
| KR | 20140107774 | A | * | 9/2014 | ..... F24F 6/12 |
| KR | 200479586 | Y1 | * | 2/2016 | ..... F24F 6/02 |
| KR | 20190017125 | A | * | 2/2019 | ..... F24F 11/0008 |
| KR | 102014700 | B1 | | 8/2019 | |
| KR | 20190140796 | A | | 12/2019 | |
| KR | 102114591 | B1 | | 5/2020 | |
| KR | 102123794 | B1 | | 6/2020 | |
| KR | 20200102164 | A | * | 8/2020 | ..... F24F 5/0042 |
| KR | 20210004759 | A | * | 1/2021 | ..... F24F 8/117 |
| WO | WO-2021194277 | A1 | * | 9/2021 | ..... F24F 11/0008 |

* cited by examiner

AIR PURIFIER WITH HUMIDIFICATION FUNCTION

CROSS-REFERENCE TO RELATED APPLICATIONS

This application claims the priority of Korean Patent Application No. 10-2023-0060117 filed on May 9, 2023, in the Korean Intellectual Property Office, the disclosure of which is incorporated herein by reference.

FIELD

The present disclosure relates to a new type of humidifier capable of functioning as a humidifier that provides water vapor and also functioning as an air purifier that purifies air using moss.

BACKGROUND

In general, since moss is a non-vascular plant belonging to bryophytes and has no vascular tissue at all, unlike other plants, the moss may not grow high and grow crawling on the ground or hanging from the stems or branches of vascular plants.

Since the moss does not have a cuticle layer that filters out foreign substances such as leaves, the moss purifies more fine dust than trees of the same area, so the moss has recently received a lot of attention as an air purifying plant.

Recently, technologies have been provided to purify air in a clean state using moss and control indoor humidity. For these technologies, various documents such as Korean Patent Laid-Open Publication No. 10-2013-0013098 (Related Art Document 1), Korean Patent No. 10-2014700 (Related Art Document 2), Korean Patent No. 10-2114591 (Related Art Document 3), Korean Patent No. 10-2123794 (Related Art Document 4) are presented.

Meanwhile, the moss serves to provide fresh air by being provided with moisture, light, and air to perform photosynthesis. To this end, in the conventional technology using moss, efforts are being made to achieve a better photosynthetic effect by continuously supplying moisture, light, and air to the moss.

However, although it is desirable for the moss to be supplied with just enough moisture to allow its leaves to bloom, the above-described conventional technologies had a problem in that moisture was supplied without considering the characteristics of the moss.

In other words, in order to provide a continuous humidification effect, moisture is continuously supplied to the moss, which causes over-humidification due to excessive moisture supply to the moss. As a result, various problems occurred, such as browning, growth inhibition, and microbial proliferation of moss.

In addition, the conventional technologies described above were only used as an air purifier using moss and cannot function as a humidifier that provides a large amount of water vapor.

In other words, since Related Art Document 4 has a structure that provides water vapor, but is configured to allow the water vapor to pass through the moss, the air that passes through the moss and is discharged indoors is only purified air and is not water vapor.

Accordingly, since the technology with the structure as in the Related Art Document 4 may not be used as a humidifier and is configured to allow air to pass through the moss all the time, the technology has a disadvantage in that moisture is continuously supplied to the moss to inevitably cause an over-humidification phenomenon.

Of course, in the case of Related Art Document 4, the operation of the humidifier may be controlled to stop to prevent the over-humidification. However, even in this case, there is a problem that damage to the moss may be inevitably caused because air is operated to pass through moss. In other words, there is a problem in that the lifespan of moss may be inevitably shortened due to dust, which requires frequent replacement of moss.

SUMMARY

The present disclosure is devised to solve various problems according to the prior art described above, an object to be achieved by the present disclosure is to provide a new type of air purifier with a humidification function capable of performing a smooth humidification operation while preventing over-humidification of moss provided for air purification.

Another object to be achieved by the present disclosure is to provide a new type of air purifier with a humidification function capable of performing an air purification function using moss while performing a function of a humidifier that humidifies a room.

According to an air purifier with a humidification function of the present disclosure, there is provided an air purifier with a humidification function, including: a body frame having a partition wall that partitions a first space at a front thereof and a second space at a rear thereof, an upper plate that is provided with a spray hole while forming an upper surface, and a bottom plate that forms a bottom surface.

According to an air purifier with a humidification function of the present disclosure, the air purifier with a humidification function of the present disclosure includes an upper frame protruding from a rear surface of the partition wall and forming a third space between the upper portion of the second space and the upper plate.

According to an air purifier with a humidification function of the present disclosure, the air purifier with a humidification function of the present disclosure includes a moss frame installed in the first space of the body frame and accommodating a moss panel.

According to an air purifier with a humidification function of the present disclosure, the air purifier with a humidification function includes a humidifier installed in the second space of the body frame, generating water vapor and discharging the generated water vapor toward the spray hole while passing through the third space.

According to an air purifier with a humidification function of the present disclosure, the air purifier with a humidification function includes a communication passage formed to communicate between the first space and the third space.

According to an air purifier with a humidification function of the present disclosure, the upper plate of the body frame is further provided with an opening/closing member that opens and closes the spray hole.

According to an air purifier with a humidification function of the present disclosure, the opening/closing member is made of a magnetic material.

According to an air purifier with a humidification function of the present disclosure, the spray hole is further provided with an opening/closing plate to close the spray hole by the magnetic force of the opening/closing member when being adjacent to the opening/closing member.

According to an air purifier with a humidification function of the present disclosure, the body frame includes a detection sensor detecting whether the spray hole is closed, and a controller controlling an operation of the humidifier based on information detected by the detection sensor.

According to an air purifier with a humidification function of the present disclosure, the humidifier includes a water tank that is installed in the second space of the body frame, and a humidifying pipe that includes an inlet located within the water tank and an outlet located to be opposite to the inlet to discharge the water vapor toward the spray hole of the upper plate through a floor of the upper frame.

According to an air purifier with a humidification function of the present disclosure, the upper frame is provided with a discharge hole that matches the outlet of the humidifying pipe and has the water vapor discharged therethrough, and the upper frame is located to be spaced apart from the upper plate so that the discharge hole may be spaced apart from the spray hole.

According to an air purifier with a humidification function of the present disclosure, the first space is formed to be partitioned from an external environment by a front cover, and the front cover is provided with an inflow hole through which indoor air is introduced.

According to an air purifier with a humidification function of the present disclosure, the inflow hole and the communication passage are each located on opposite sides of the first space.

According to an air purifier with a humidification function of the present disclosure, the moss frame has a rear wall surface on which the moss panel is seated and a circumferential wall surface provided along a circumference of the rear wall surface, and at least one area of the circumferential wall surface is formed to protrude toward the moss panel for gripping the moss panel.

As described above, according to the air purifier with a humidification function of the present disclosure, by performing the function of humidifying the room and selectively providing the water vapor to the moss, it is possible to obtain clean air according to a photosynthetic effect.

In addition, according to the air purifier with a humidification function of the present disclosure, when the water vapor is provided through the moss, the water vapor is controlled to be provided only for the set time, so it is possible to prevent the over-humidification of the moss.

In addition, according to the air purifier with a humidification function of the present disclosure, since the pressure difference between the third space and the first space may be further increased by additionally providing the front cover, it is possible to allow the air passing through the moss panel within the first space to be smoothly carried on the water vapor discharged through the spray hole.

In addition, according to the air purifier with a humidification function of the present disclosure, it is possible to prevent the oil film from being formed in the spray hole by additionally providing the opening/closing plate.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF EXEMPLARY EMBODIMENTS

Figure 1:
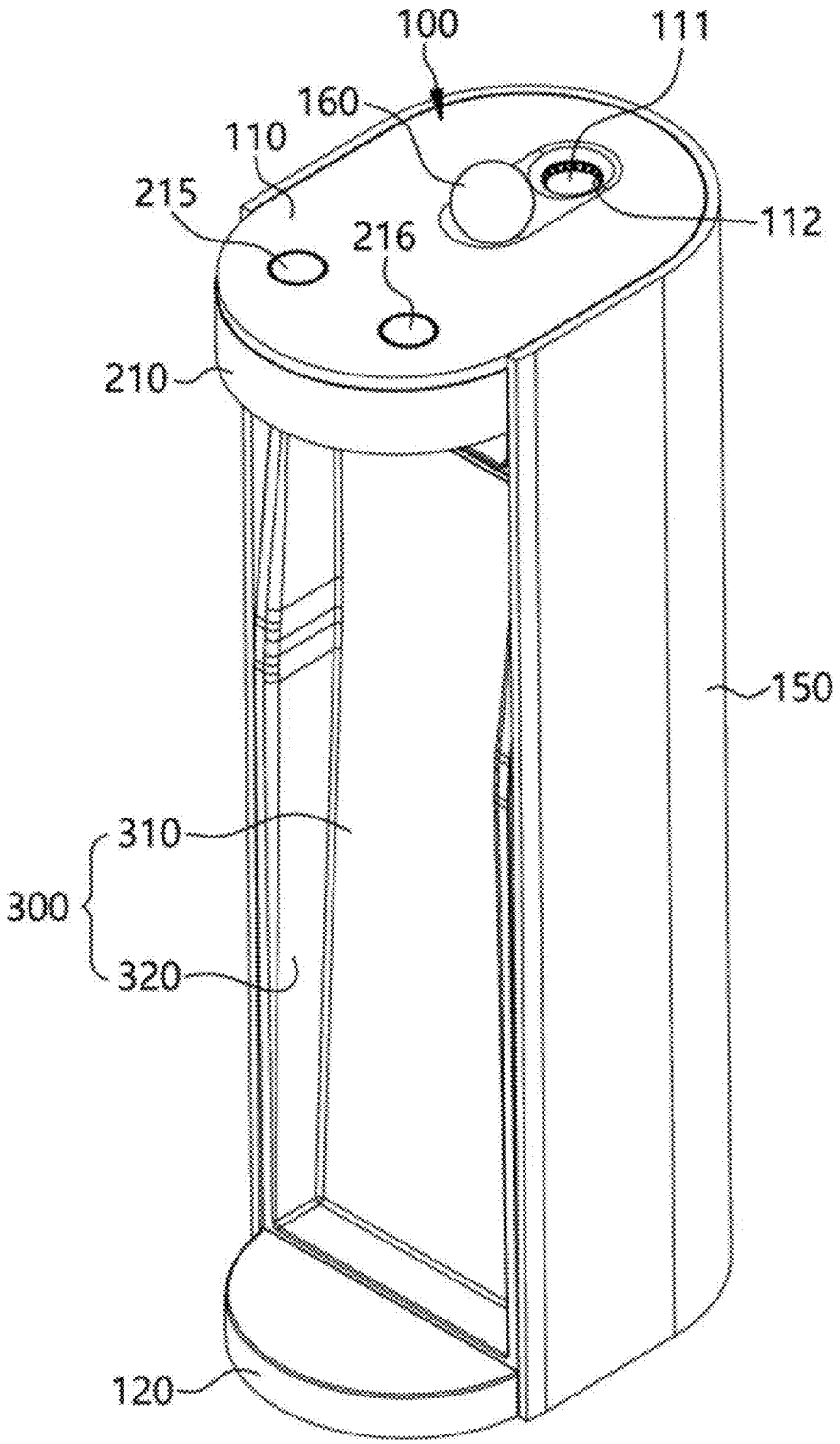
FIGS. 1 and 2 are perspective views of an air purifier with a humidification function according to an exemplary embodiment of the present disclosure in each direction viewed from the top and bottom.
Figure 2:
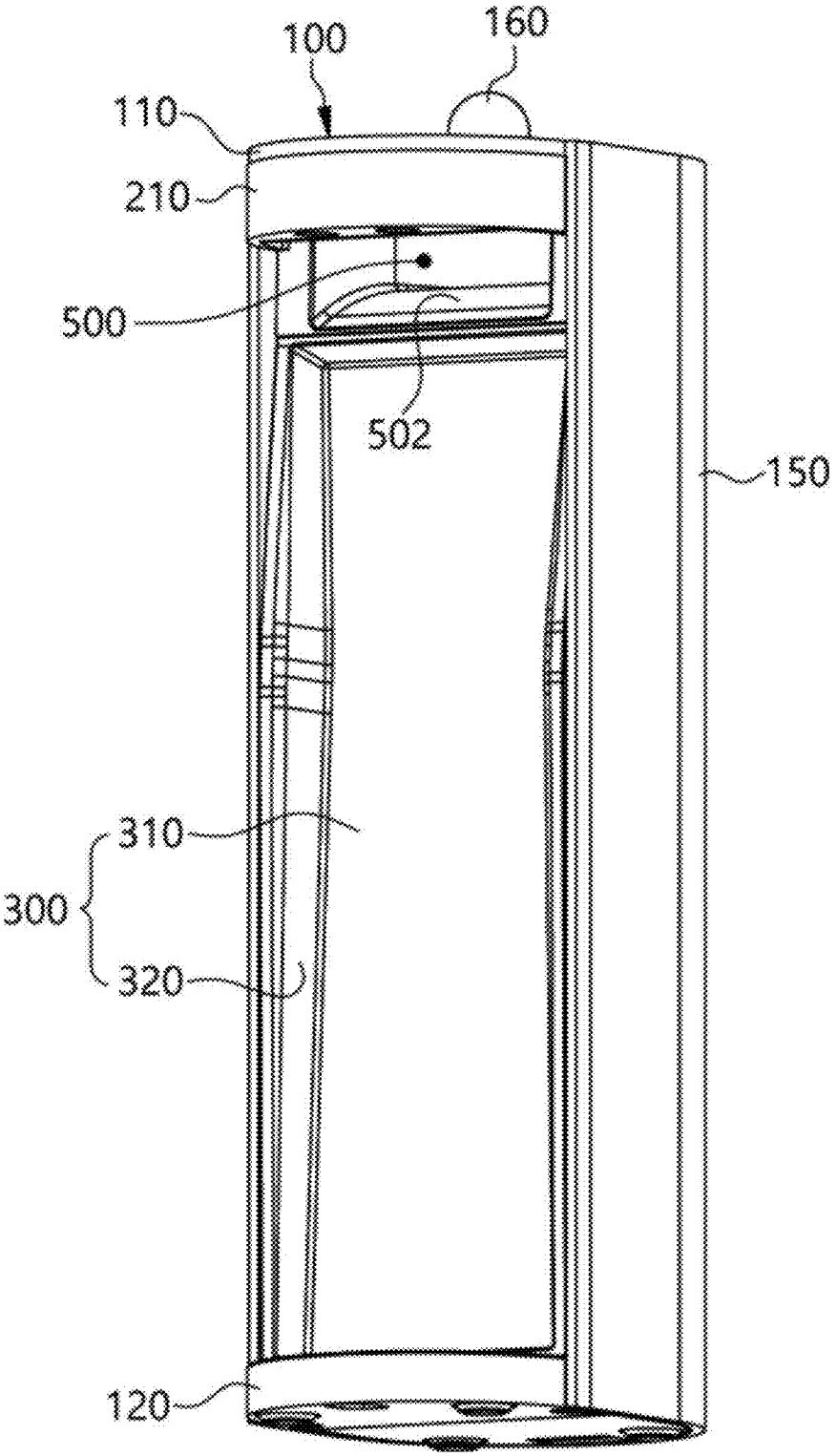
Figure 3:
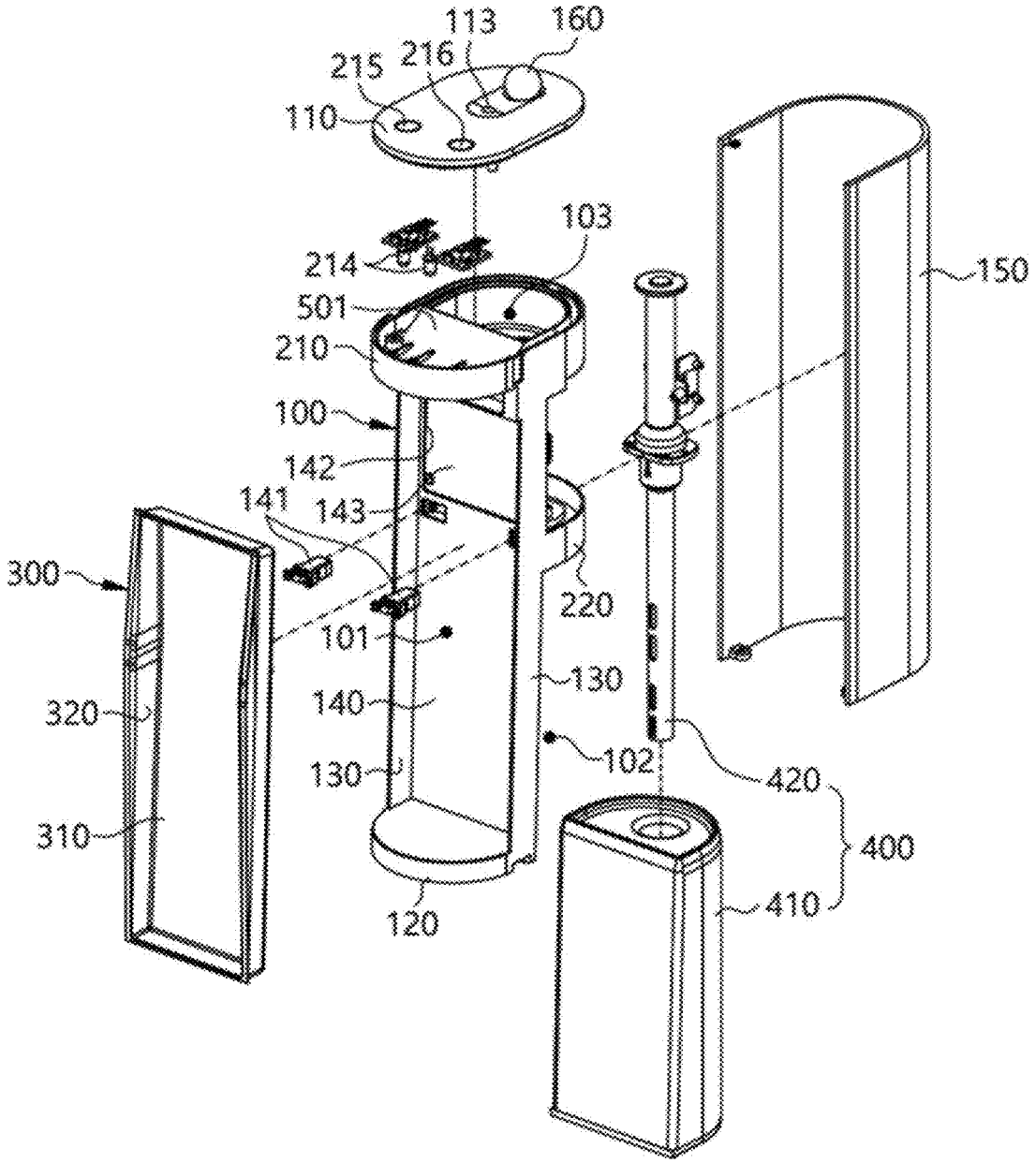
FIGS. 3 and 4 are exploded perspective views of the air purifier with a humidification function according to an exemplary embodiment of the present disclosure in each direction viewed from the front and rear.
Figure 4:
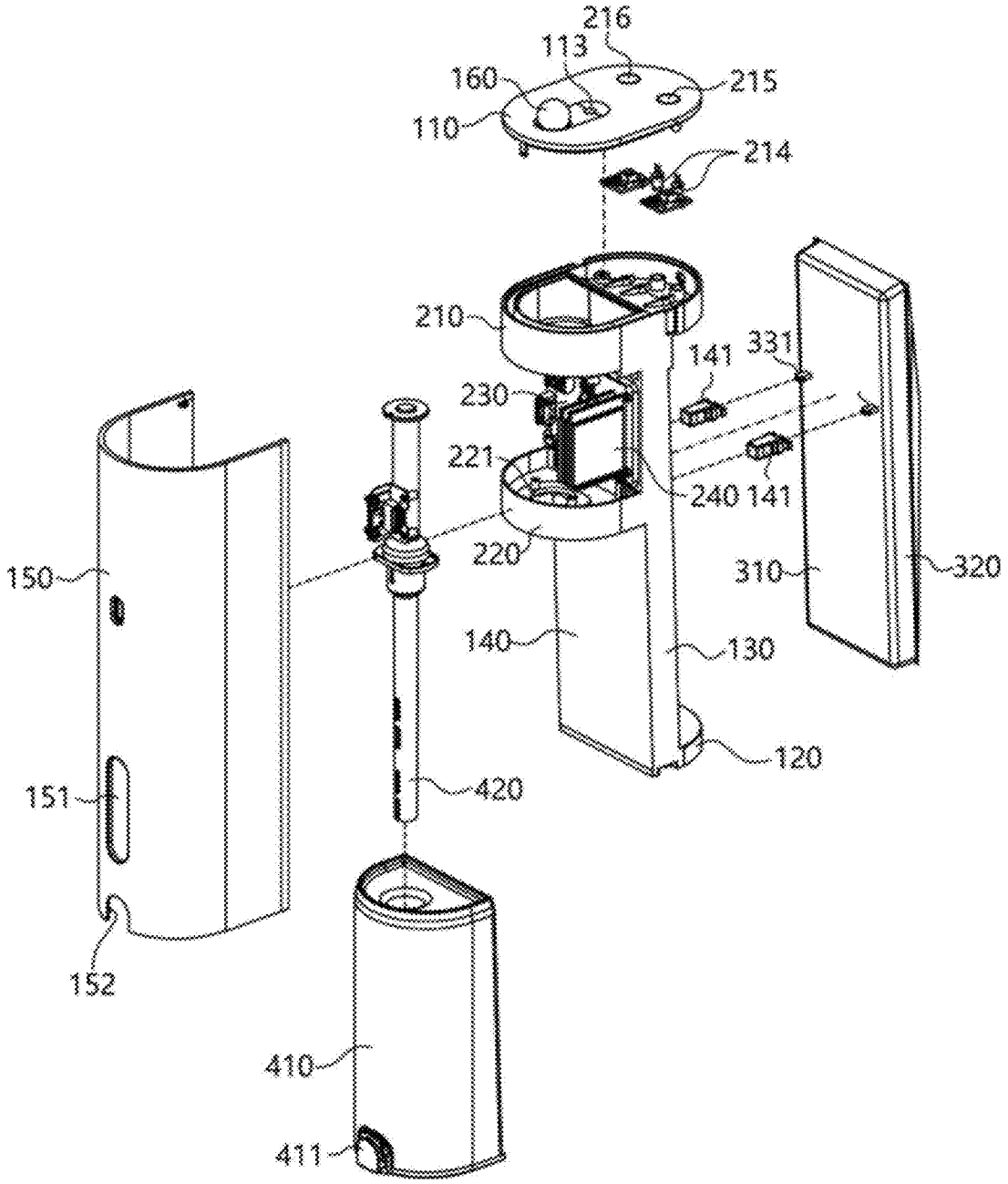

Hereinafter, exemplary embodiments of the present disclosure will be described in detail with reference to the accompanying drawings.

It is to be noted that in giving reference numerals to components of respective drawings, the same components will be denoted by the same reference numerals even though they are illustrated in different drawings. Further, in describing exemplary embodiments of the present disclosure, well-known constructions or functions will not be described in detail in the case in which it is decided that they may unnecessarily obscure the understanding of exemplary embodiments of the present disclosure.

In addition, terms 'first', 'second', A, B, (a), (b), and the like, will be used in describing components of exemplary embodiments of the present disclosure. These terms are used only to distinguish the components from other components, and the nature, sequence, order, or the like, of the corresponding components are not limited by these terms. When it is mentioned that any component is "connected" or "coupled" to another component, it is to be understood that any component is directly connected or coupled to another component or is connected or coupled to another component with the other component interposed therebetween.

Next, a preferred exemplary embodiment of an air purifier with a humidification function of the present disclosure will be described with reference to FIGS. 1 to 17 attached.

Figure 5:
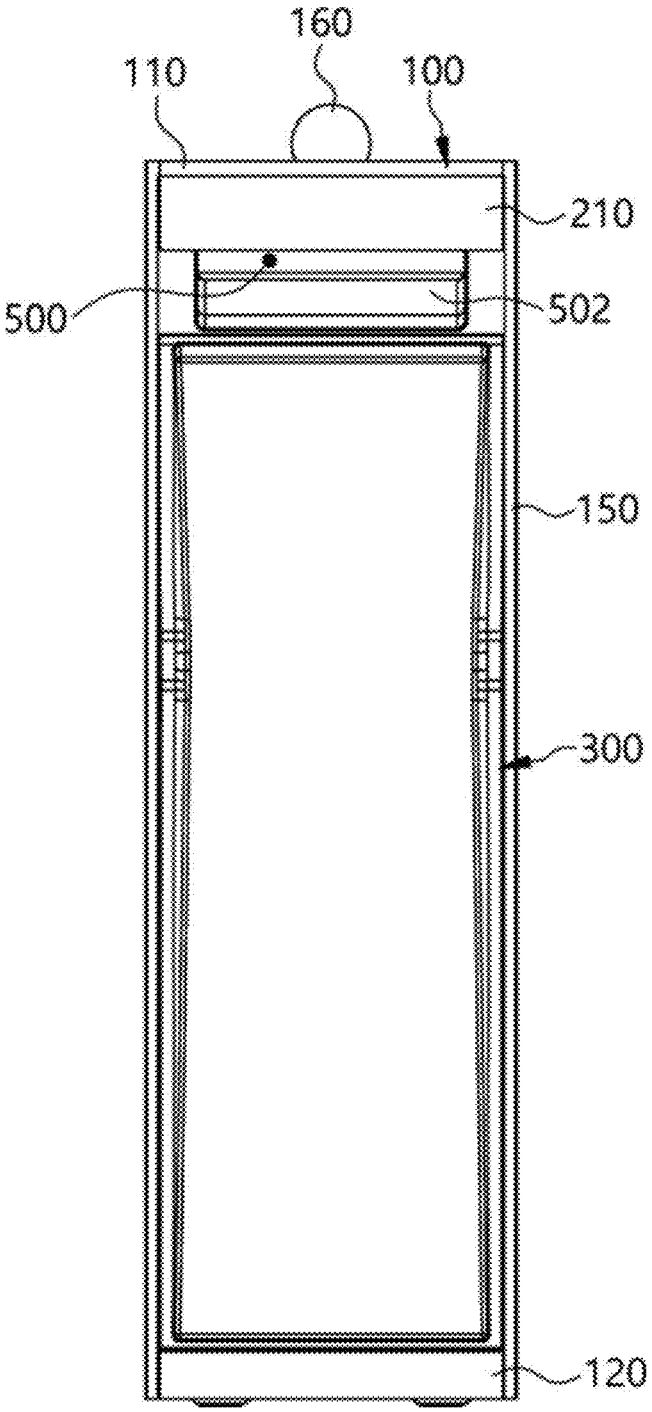
FIG. 5 is a front view of the air purifier with a humidification function according to an exemplary embodiment of the present disclosure.
Figure 6:
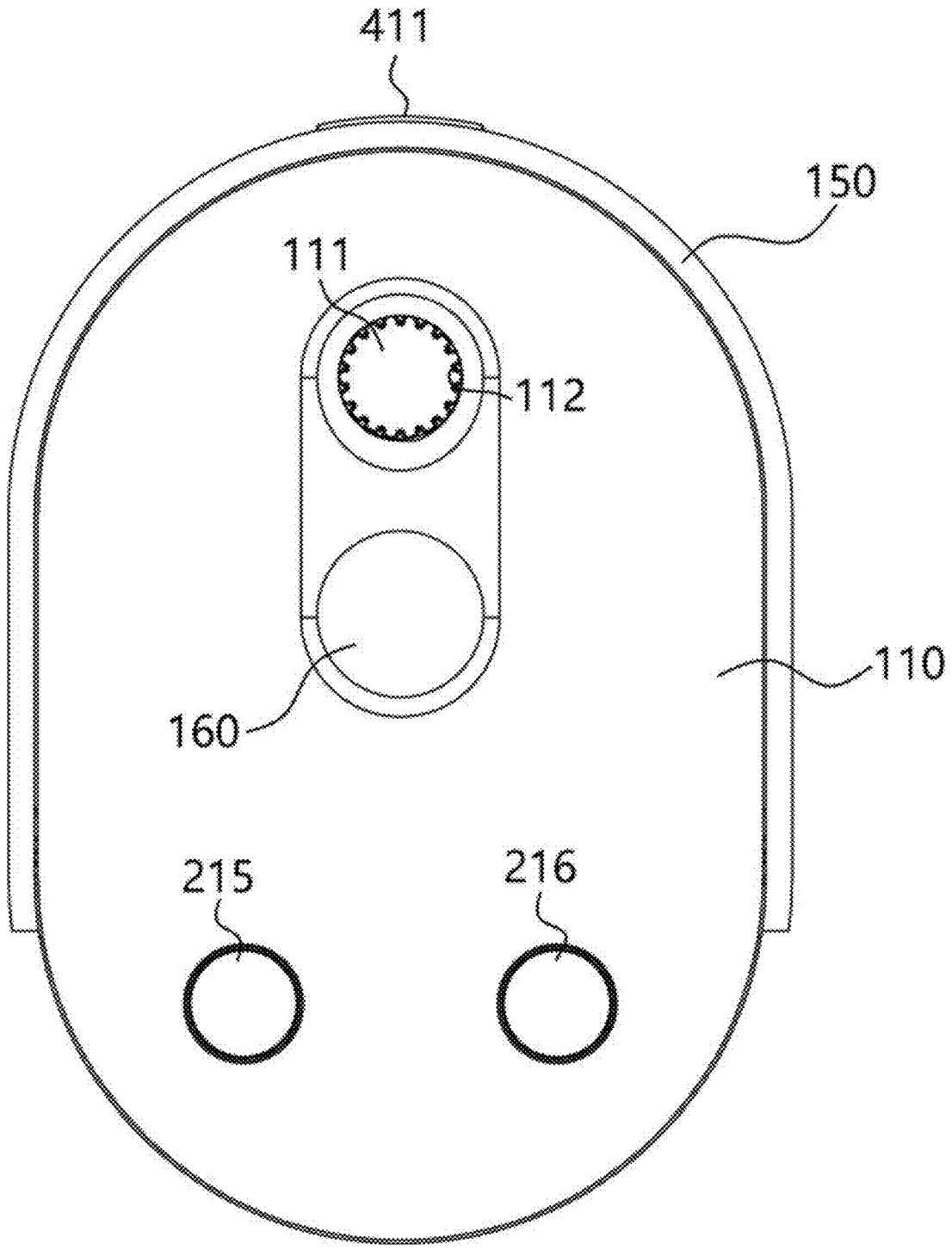
FIG. 6 is a plan view of the air purifier with a humidification function according to an exemplary embodiment of the present disclosure.
Figure 7:
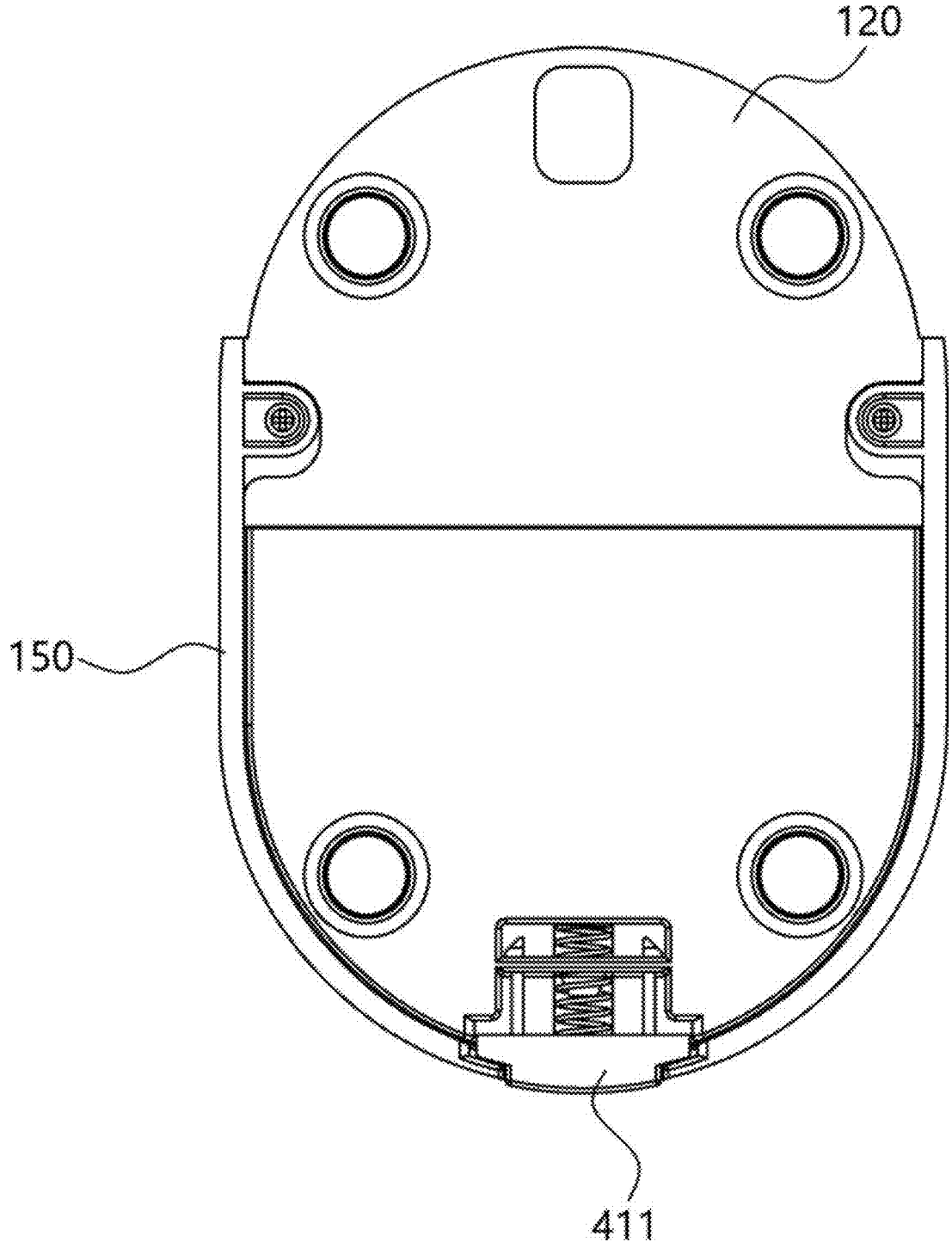
FIG. 7 is a bottom view of the air purifier with a humidification function according to an exemplary embodiment of the present disclosure.
Figure 8:
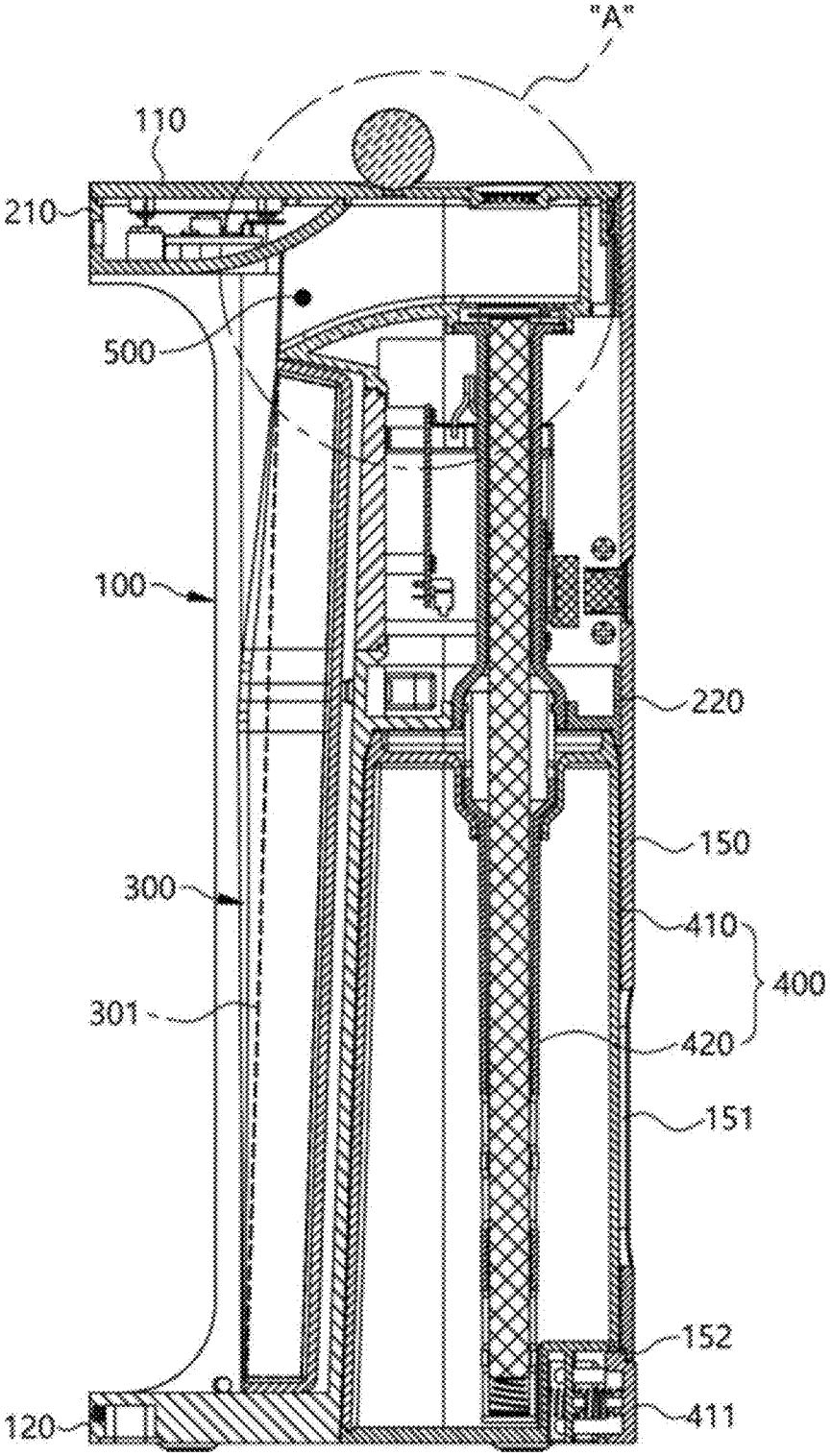
FIG. 8 is a cross-sectional view of the air purifier with a humidification function according to an exemplary embodiment of the present disclosure.
Figure 9:
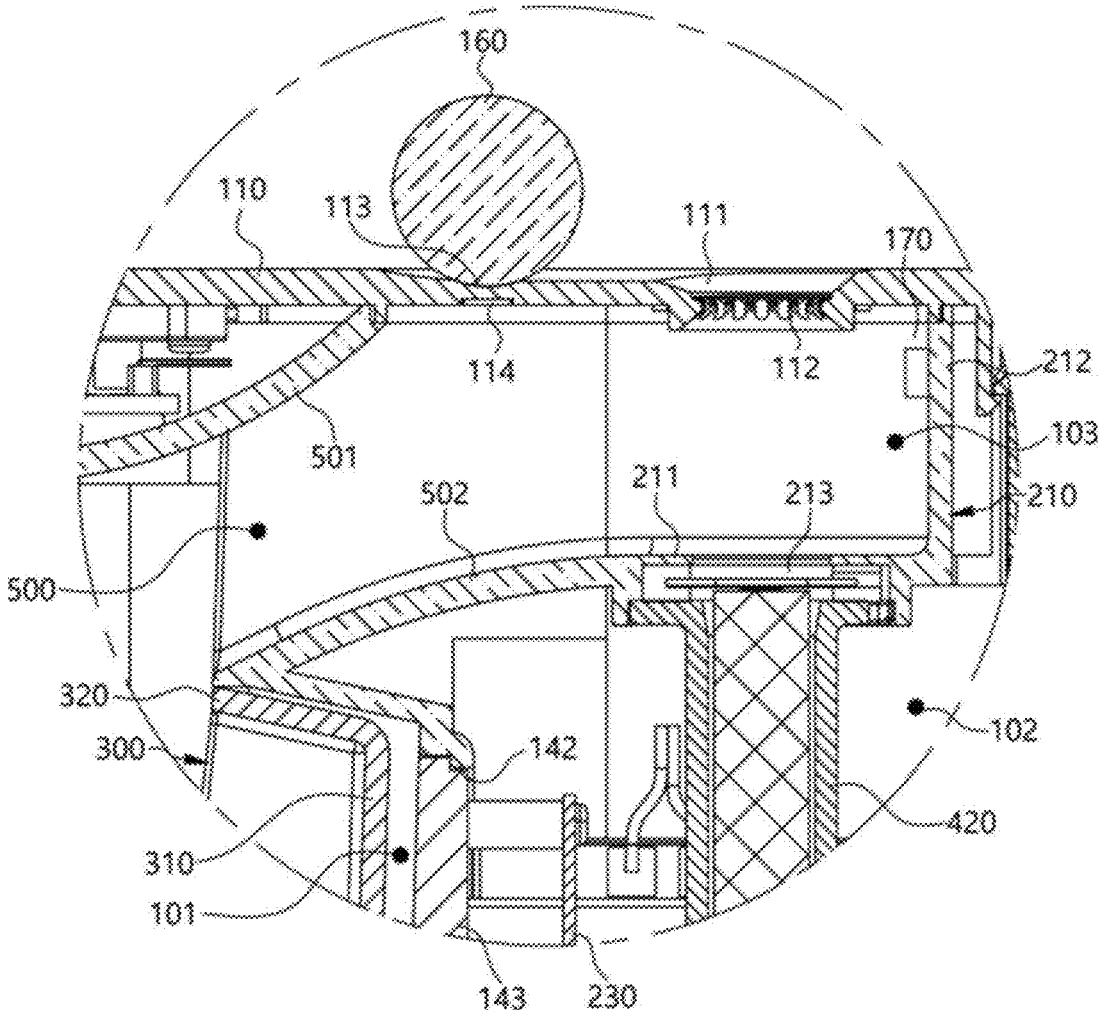
FIG. 9 is an enlarged view of part A of FIG. 8.

The attached FIGS. 1 to 4 are perspective views and exploded perspective views of an air purifier with a humidification function according to an exemplary embodiment of the present disclosure in each direction. In addition, FIGS. 5 to 7 are state diagrams of the air purifier with a humidification function according to an exemplary embodiment of the present disclosure in each direction. In addition, FIGS. 8 and 9 are a cross-sectional view and an enlarged view of main parts of the air purifier with a humidification function according to an exemplary embodiment of the present disclosure.

As illustrated in these drawings, the air purifier with a humidification function according to an exemplary embodiment of the present disclosure includes a first space 101 in which a moss frame 300 is installed, a second space 102 in which a humidifier 400 is installed, and a third space 103 in which water vapor generated from the humidifier 400 is discharged, and may allow air passing through moss to be sprayed indoors while being carried on the water vapor due to a pressure difference between the third space 103 and the first space 101 that is generated while the water vapor passes through the third space 103 and is sprayed into a spray hole 111.

In addition, the water vapor may also be supplied to the moss by selectively closing the spray hole 111.

The air purifier with a humidification function according to an exemplary embodiment of the present disclosure will be described in more detail for each component as follows.

First, the air purifier with a humidification function according to an exemplary embodiment of the present disclosure includes a body frame 100.

The body frame 100 forms an exterior body of the air purifier with a humidification function.

The body frame 100 has an upper plate 110 forming an upper surface, a bottom plate 120 forming a bottom surface, and side walls 130 forming both side surfaces, and the front and rear surfaces are formed to be open.

The body frame 100 is formed to have the first space 101 and the second space 102 partitioned from each other. The first space 101 and the second space 102 may be partitioned by a partition wall 140. For example, the partition wall 140 may be formed to partition front and rear spaces of the body frame 100 while being located at a central area of the body frame 100. In this case, the first space 101 may be a space located on a front side of the body frame 100 with the partition wall 140 as the center, and the second space 102 may be a space located on a rear side of the body frame 100 with the partition wall 140 as the center.

The spray hole 111 is formed in the upper plate 110 forming the body frame 100 for indoor discharge of water vapor sprayed from the humidifier 400, which will be described later. The spray hole 111 is formed to be located on an upper side of the second space 102 of the upper plate 110.

The spray hole 111 is formed to penetrate through the upper plate 110 up and down, and an upper surface (an area where the spray hole is located in the upper surface of the upper plate) of the spray hole 111 is formed to be concave toward the center. In this way, moisture generated around the spray hole 111 may smoothly flow down into the spray hole 111 while the water vapor passes through the spray hole 111.

In particular, a plurality of irregularities 112 is continuously and repeatedly formed on an inner peripheral surface of the spray hole 111 along its circumferential direction. These irregularities 112 may serve to prevent an oil film from being formed in the spray hole 111.

The bottom plate 120 forming the body frame 100 is provided to form a floor of the first space 101. In this case, the floor of the second space 102 is formed to be open.

Next, the air purifier with a humidification function according to an exemplary embodiment of the present disclosure includes an upper frame 210.

The upper frame 210 is formed at an upper end of the body frame 100, and provided with a third space 103 partitioned from the first space 101 and the second space 102 by the upper frame 210.

The upper frame 210 is formed to have a floor 211 that separates the third space 103 from the second space 102 and a circumferential wall 212 that forms a circumference of the third space 103. That is, the third space 103 may be defined as an inner space between the floor 211 and the circumferential wall 212 forming the upper frame 210.

A discharge hole 213 passing through the top and bottom is formed on the floor of the upper frame 210. The discharge hole 213 is located to face the spray hole 111 formed in the upper plate 110, and acts to guide the water vapor discharged from the humidifier 400, which will be described later, to be discharged toward the spray hole 111.

The upper frame 210 is located to be spaced apart from the upper plate 110 so that the discharge hole 213 may be spaced apart from the spray hole 111. Considering this, the third space 103 may also be defined as a space from the outlet through which the water vapor of the humidifier 400 provided in the second space 102 is sprayed to the spray hole 111.

The upper plate 110 of the body frame 100 is formed separately from the upper frame 210 and is coupled to cover the upper surface of the upper frame 210.

Meanwhile, a lamp 214 for irradiating light to the first space 101 may be provided on a front upper surface of the upper frame 210. At least one lamp 214 may be provided, and may be installed to irradiate light through the floor of the upper frame 210 toward a front surface of the partition wall 140 forming the body frame 100.

When the lamp 214 is provided in the upper frame 210, the partition wall 140 is preferably formed to be inclined forward toward the bottom. As a result, the entire moss panel 301 (see FIG. 8) of the moss frame 300, which will be described later, seated on a front surface of the partition wall 140, may be configured to uniformly receive light emitted from the lamp 214.

Of course, by installing the lamp 214 at an angle, the entire moss panel 301 may be configured to uniformly receive light emitted from the lamp 214.

The inclined structure of the partition wall 140 plays a more advantageous role in ensuring that water vapor is sufficiently provided to an area below the moss panel 301 when the water vapor flows down the surface of the moss panel 301.

Meanwhile, at least one switch 215 or 216 may be provided on the front upper surface of the upper frame 210 for the operation of the lamp 214, the humidifier 400, which will be described later, or for supplying power to a device, etc.

For example, a switch 215 for turning on/off the humidifier 400 and a switch 216 for turning on/off the lamp 214 may each be provided on the front upper surface of the upper frame 210.

Next, the air purifier with a humidification function according to an exemplary embodiment of the present disclosure includes the moss frame 300.

The moss frame 300 is formed as a box body in which the moss panel 301 in which the moss is blocked is accommodated.

For example, the moss frame 300 has an open front surface and is formed to have a rear wall surface 310 on which the moss panel 301 is seated and a circumferential wall surface 320 provided along the circumference of the rear wall surface 310.

At least one area of the circumferential wall surface 320 forming the moss frame 300 may be formed to protrude toward an internal space of the moss frame 300. That is, the moss panel 301 seated on the inside thereof may be stably gripped by a protruding structure on one area of the circumferential wall surface 320. In this case, it is preferable that the protruding area is formed on two circumferential wall surfaces 320 opposite to each other, respectively.

In addition, a wall surface of the protruding area of the circumferential wall surface 320 of the moss frame 300 may be formed to gradually increase in height (accommodating depth of the moss panel) toward the protruding area. Accordingly, when the moss frame 300 is separated from the body frame 100, the protruding area may also be used as a gripping area.

The moss frame 300 is detachably coupled to the front surface of the partition wall 140 forming the body frame 100. This detachable structure allows the moss frame 300 to be maintained in close contact with the front surface of the partition wall 140.

For example, the detachable structure may be configured as a hook structure. That is, a hook 331 may be formed to protrude from a rear surface of the moss frame 300, and a push lock button 141 that is caught while the hook 331 is accommodated is elastically installed on the partition wall 140, so the moss frame 300 may be separated by being selectively spaced apart from the partition wall 140. In this case, the push lock button 141 is a button that is configured to grip the hook 331 when pressed once and to push the hook 331 while releasing the gripping of the hook 331 when pressed once again.

Next, the air purifier with a humidification function according to an exemplary embodiment of the present disclosure includes the humidifier 400.

The humidifier 400 is installed in the second space 102 of the body frame 100 and serves to generate water vapor and discharge the water vapor toward the spray hole 111 while passing through the third space 103.

The humidifier 400 includes a water tank 410 in which water is stored and a humidifying pipe 420 that guides the flow of the water vapor generated using the water.

The water tank 410 is installed in the second space 102 of the body frame 100.

A mounting frame 220 for mounting the water tank 410 is formed on the body frame 100. The mounting frame 220 is formed to be located at a bottom portion of the upper frame 210 while being formed to protrude from the rear surface of the partition wall 140 to cross the second space 102. A lower circumference of the mounting frame 220 is formed to surround an upper circumference of the water tank 410. Accordingly, the water tank 410 may be installed in a space between the mounting frame 220 and the bottom plate 120 of the body frame 100 in the second space 102.

A through hole 221 passing through the top and bottom is formed in the mounting frame 220. The humidifying pipe 420 has an inlet that is located within the water tank 410 and an outlet that passes through the through hole 221 of the mounting frame 220 and then installed in close contact with the discharge hole 213 formed on the floor 211 of the upper frame 210. As a result, the water vapor flowing through the humidifying pipe 420 may pass through the discharge hole 213 and may be discharged toward the spray hole 111 of the upper plate 110.

An ultrasonic vibrator (not illustrated) may be provided within the humidifying pipe 420. As a result, the water in the water tank 410 may be vaporized and flow along the humidifying pipe 420 without using a separate pump or fan. The ultrasonic vibrator may be provided in at least one area of the inside, upper end, or lower end of the humidifying pipe 420.

Meanwhile, the mounting frame 220 is formed to be spaced apart from the upper frame 210 by a predetermined distance. As a result, a predetermined mounting space 104 may be formed between the mounting frame 220 and the upper frame 210 in the second space 102, and electronic components, such as a circuit board 230 or a battery 240, including a controller (not illustrated) may be installed in the mounting space 104. The controller may be configured to control the operation of the humidifier 400 and the lamp 214.

An opening 142 may be formed in the partition wall 140 of the body frame 100 to communicate between the mounting space 104 and the first space 101. In this case, a mounting plate 143 is provided to close the opening 142 while being detachably coupled to the opening 142, and the electronic components (circuit board and battery) 230 and 240 are fixed to the rear surface of the mounting plate 143. As a result, maintenance of the electronic components 230 and 240 is possible without separating the humidifier 400 from the body frame 100 by an operation of separating the mounting plate 143 forward.

Meanwhile, a rear cover 150 is provided on the rear surface of the body frame 100. The rear cover 150 forms the rear surface and both side wall surfaces of the air purifier with a humidification function according to an exemplary embodiment of the present disclosure while blocking the second space (the space between the mounting frame and the upper frame and the space in which the water tank is installed) 102 from the external environment. Both side wall surfaces of the rear cover 150 may be formed as a flat surface, and the rear surface of the rear cover 150 may be formed as a rounded curved surface.

A see-through hole 151 may be formed on a portion of the rear surface of the rear cover 150. As a result, the user may check a level of water stored in the water tank 410 through the see-through hole 151.

A restraining jaw 152 is formed at a lower end of the rear surface of the rear cover 150, and a restraining member 411 that is caught by the restraining jaw 152 may be provided at the lower end of the rear surface of the water tank 410. As a result, the lower end of the water tank 410 may be supported while installed on the rear cover 150. The restraining member 411 is formed as a button structure that is elastically installed at a lower end of the rear surface of the water tank 410 so that it is separated from the restraining jaw 152 when a pressing operation occurs.

Next, the air purifier with a humidification function according to an exemplary embodiment of the present disclosure includes a communication passage 500.

The communication passage 500 is formed as a passage through which the first space 101 and the third space 103 communicate. This communication passage 500 serves to guide the water vapor sprayed from the humidifier 400 and discharged to the spray hole 111 through the third space 103 to flow into the first space 101 or guide the air in the first space 101 to be carried on the water vapor discharged indoors through the spray hole 111.

The communication passage 500 is formed on the upper side of the body frame 100, and an upper surface 501 and a bottom surface 502 are formed to be inclined or rounded.

For example, the upper surface 501 of the communication passage 500 is formed to be gradually inclined upward or rounded as it moves from the first space 101 to the third space 103 so that the air flowing into the first space 101 flows toward the spray hole 111 or the bottom surface of the upper plate 110.

The bottom surface of the communication passage 500 is formed to be inclined or rounded up to the upper front surface of the moss frame 300 so that the water vapor in the third space 103 may flow down along the front surface of the moss frame 300 in the first space 101.

Meanwhile, the air purifier with a humidification function according to an exemplary embodiment of the present disclosure may further include an opening/closing member 160 for opening/closing the spray hole 111 formed in the upper plate 110.

That is, when the spray hole 111 is closed by the opening/closing member 160, most (or all) of the water vapor sprayed through the humidifying pipe 420 of the humidifier 400 may flow into the first space 101 through the communication passage 500.

The opening/closing member 160 may be made of spherical metal. In other words, the spherical shape may allow the circular spray hole 111 to be completely closed, and the weight of the metal material may be used to prevent the spray hole 111 from lifting due to the water vapor.

A storage groove 113 in which the opening/closing member 160 may be stored is formed in the upper plate 110.

The opening/closing member 160 may be made of a magnetic material. In addition, a magnetic member (e.g., a metal plate or another magnetic material) 114 to which the opening/closing member 160 may be attached may be provided in the storage groove 113 of the upper plate 110. That is, the opening/closing member 160 may be attached to the magnetic member 114 while being stored in the storage groove 113 to prevent the risk of loss.

In addition, the air purifier with a humidification function according to an exemplary embodiment of the present disclosure may further include a detection sensor 170 that detects whether the spray hole 111 is closed. The detection sensor 170 may be configured as a hall sensor located adjacent to the spray hole 111. That is, considering that the opening/closing member 160 is made of a magnetic material, the detection sensor 170 may detect whether the opening/closing member 160, which is the magnetic material, is adjacent to determine whether the spray hole 111 is closed.

When the detection sensor 170 is provided, the controller (not illustrated) may be configured to control the operation of the humidifier 400 based on the information detected by the detection sensor 170. In particular, when the controller confirms that the spray hole 111 is closed by the detection sensor 170, the controller may control the humidifier 400 to operate only for the set time. In other words, considering that when the spray hole 111 is closed, the water vapor generated by the humidifier 400 is provided to the moss panel 301, the water vapor may be provided only during the time under the condition that the moss of the moss panel 301 is not over-humidified.

Figure 10:
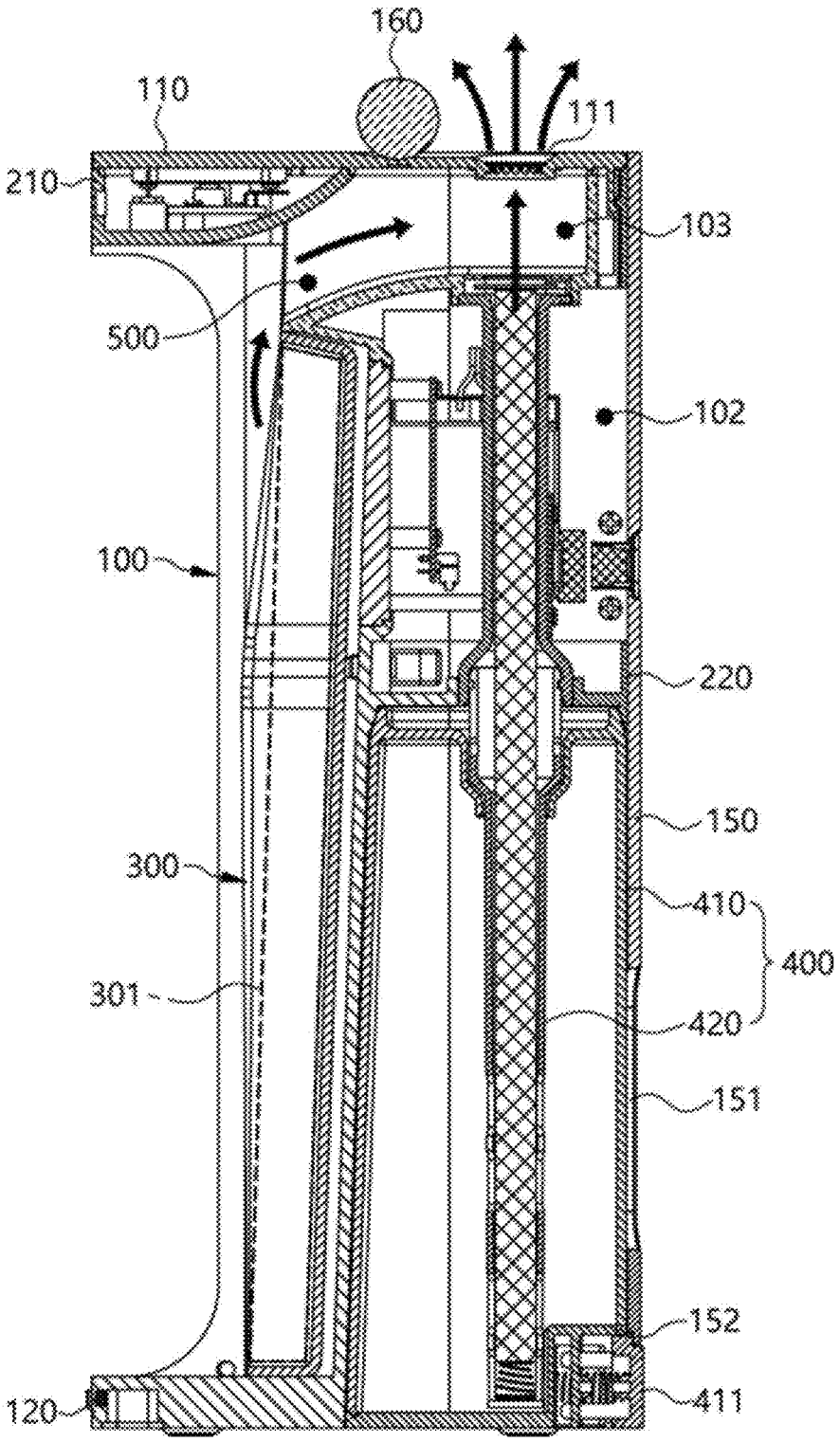
FIGS. 10 and 11 are operation state diagrams for each function of the air purifier with a humidification function according to an exemplary embodiment of the present disclosure.

In the following, the operation of the air purifier with a humidification function according to the exemplary embodiment of the present disclosure described above will be described in more detail with reference to FIGS. 10 and 11.

First, the air purifier with a humidification function according to an exemplary embodiment of the present disclosure operates under the selective control of the controller depending on whether or not the request to use the air purifier is generated. The use of the air purifier with a humidification function may be requested by a manual operation by a user or may be requested when the preset conditions are met. In this case, the preset conditions may include, for example, at least one of conditions according to the time period, conditions according to the humidity around the device, conditions according to the illuminance around the device, conditions according to the air quality around the device, and conditions according to the temperature around the device.

When the set conditions for the use of the air purifier with a humidification function are met, the controller controls to supply power to the humidifier 400 and generate water vapor.

In addition, the water vapor generated by the operation (operation of the ultrasonic vibrator) of the humidifier 400 passes through the discharge hole 213 formed in the upper frame 210 while flowing along the humidifying pipe 420 and is discharged into the third space 103.

In this case, considering that the outlet (or discharge hole) of the humidifying pipe 420 is formed to face the spray hole 111 formed in the upper plate 110, the water vapor discharged into the third space 103 passes through the spray hole 111 and is sprayed indoors. In this way, the humidification operation for the room is performed. This is as illustrated in FIG. 10.

Figure 11:
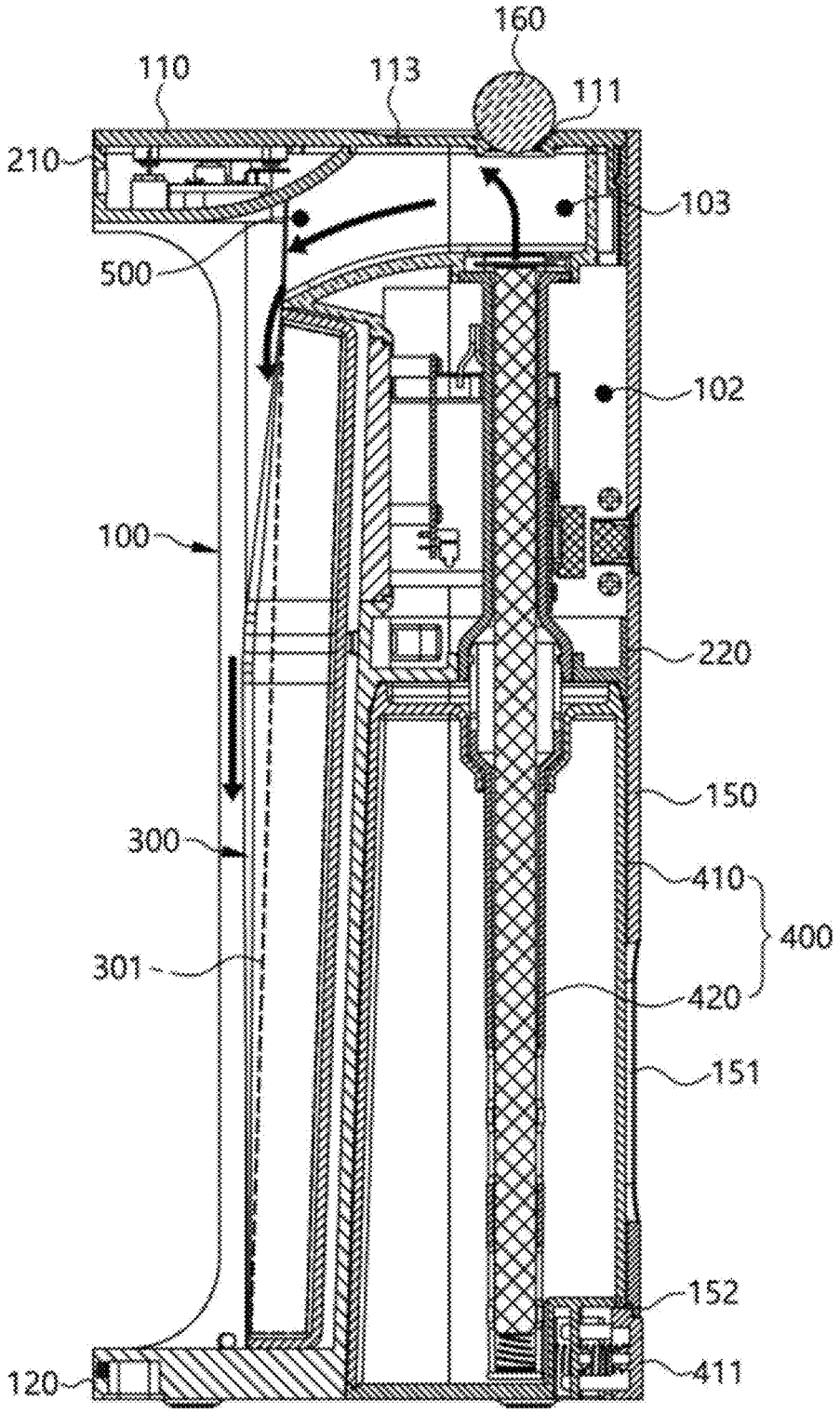
Figure 12:
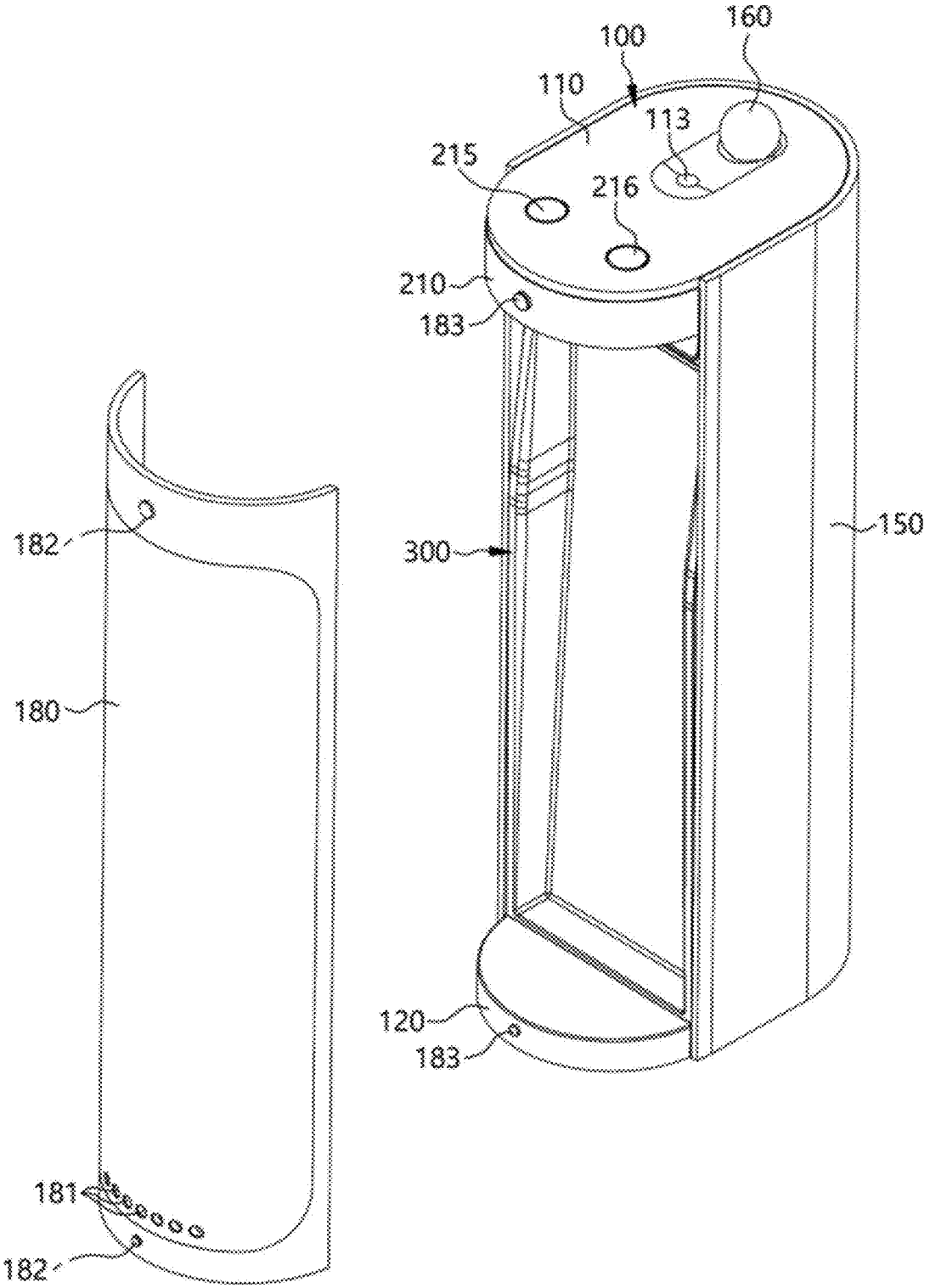
FIG. 12 is an exploded perspective view of an air purifier with a humidification function according to another exemplary embodiment of the present disclosure.
Figure 13:
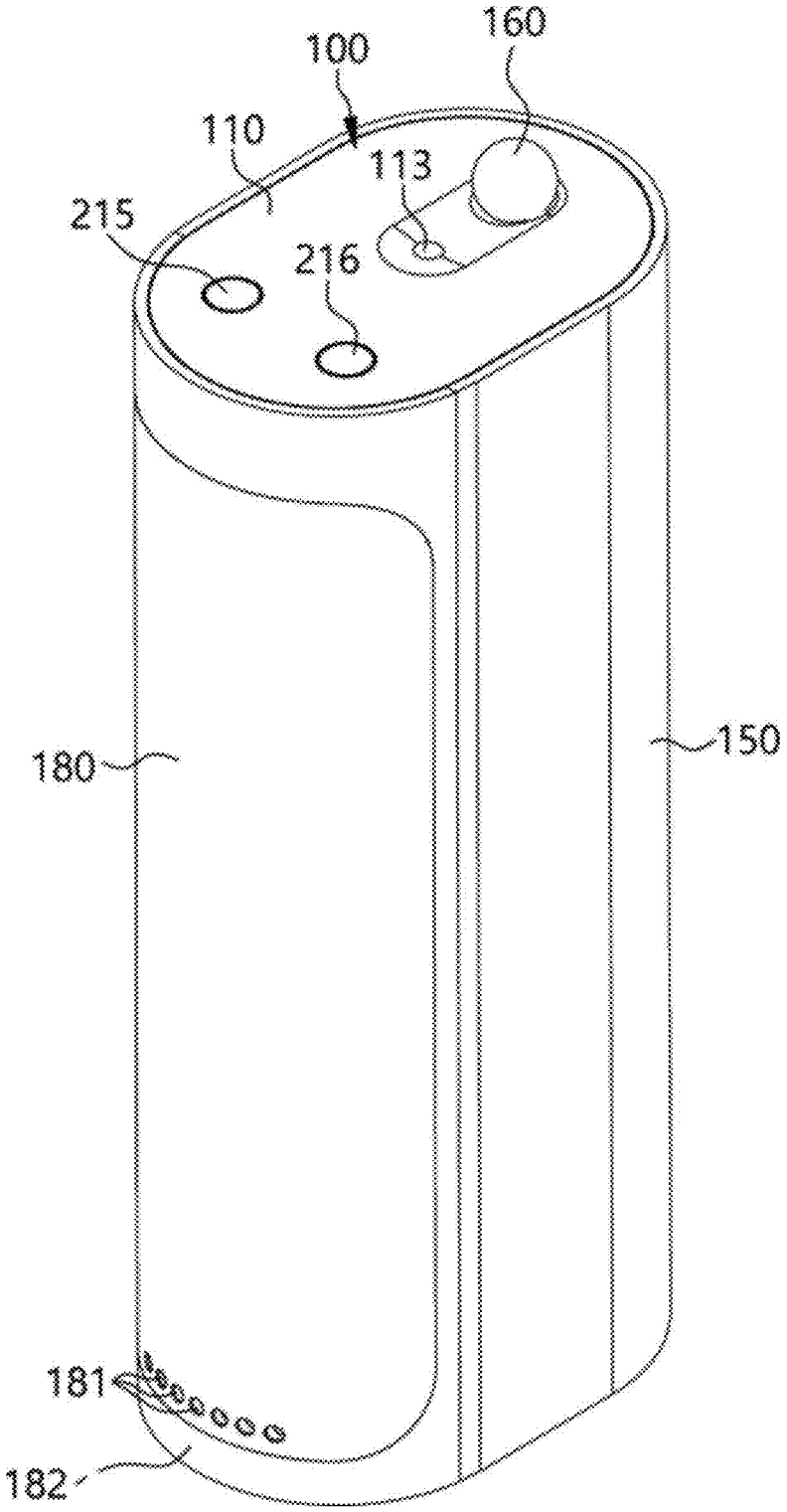
FIG. 13 is a perspective view of the air purifier with a humidification function according to another exemplary embodiment of the present disclosure.
Figure 14:
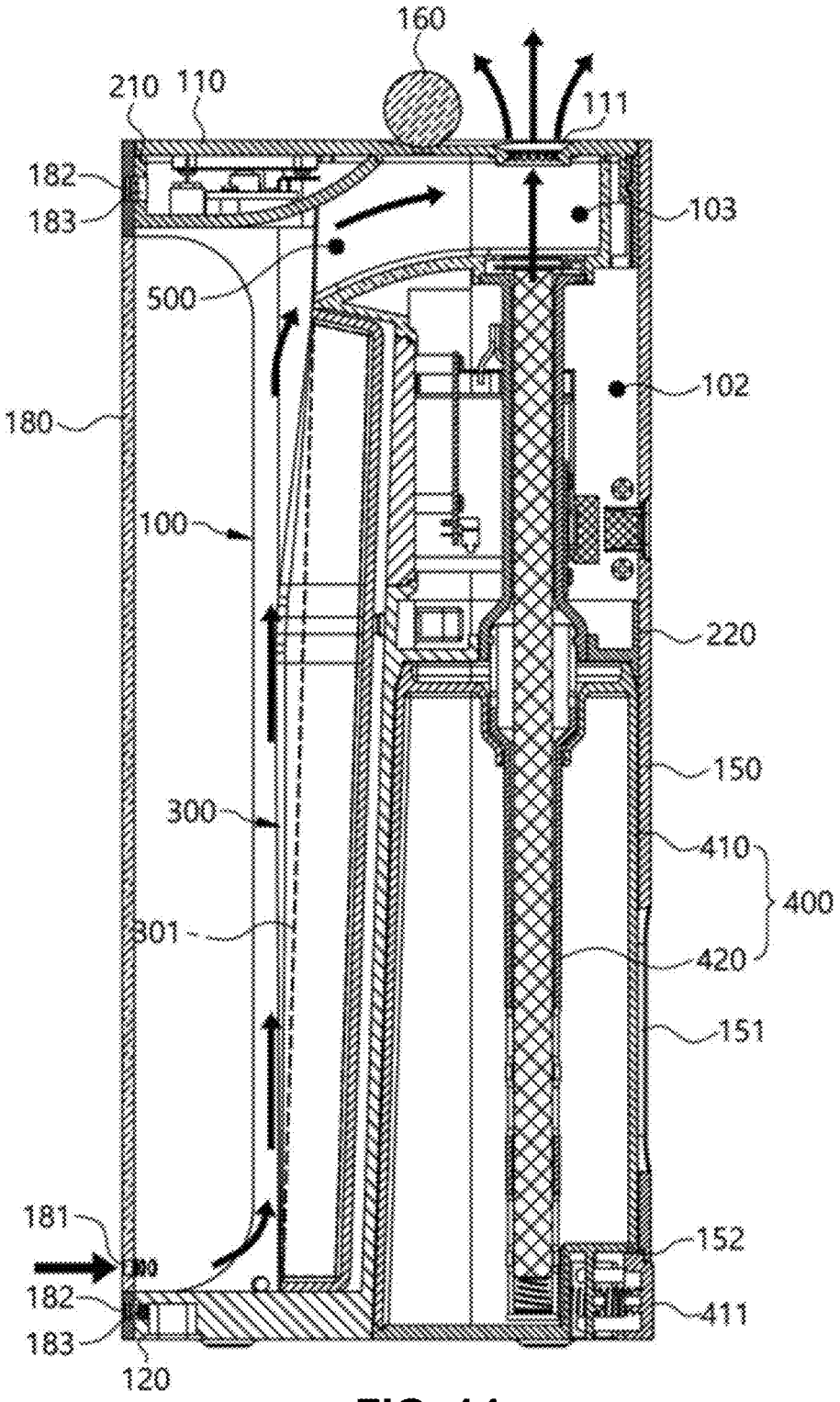
FIGS. 14 and 15 are operation state diagrams for each function of an air purifier with a humidification function according to another exemplary embodiment of the present disclosure.
Figure 15:
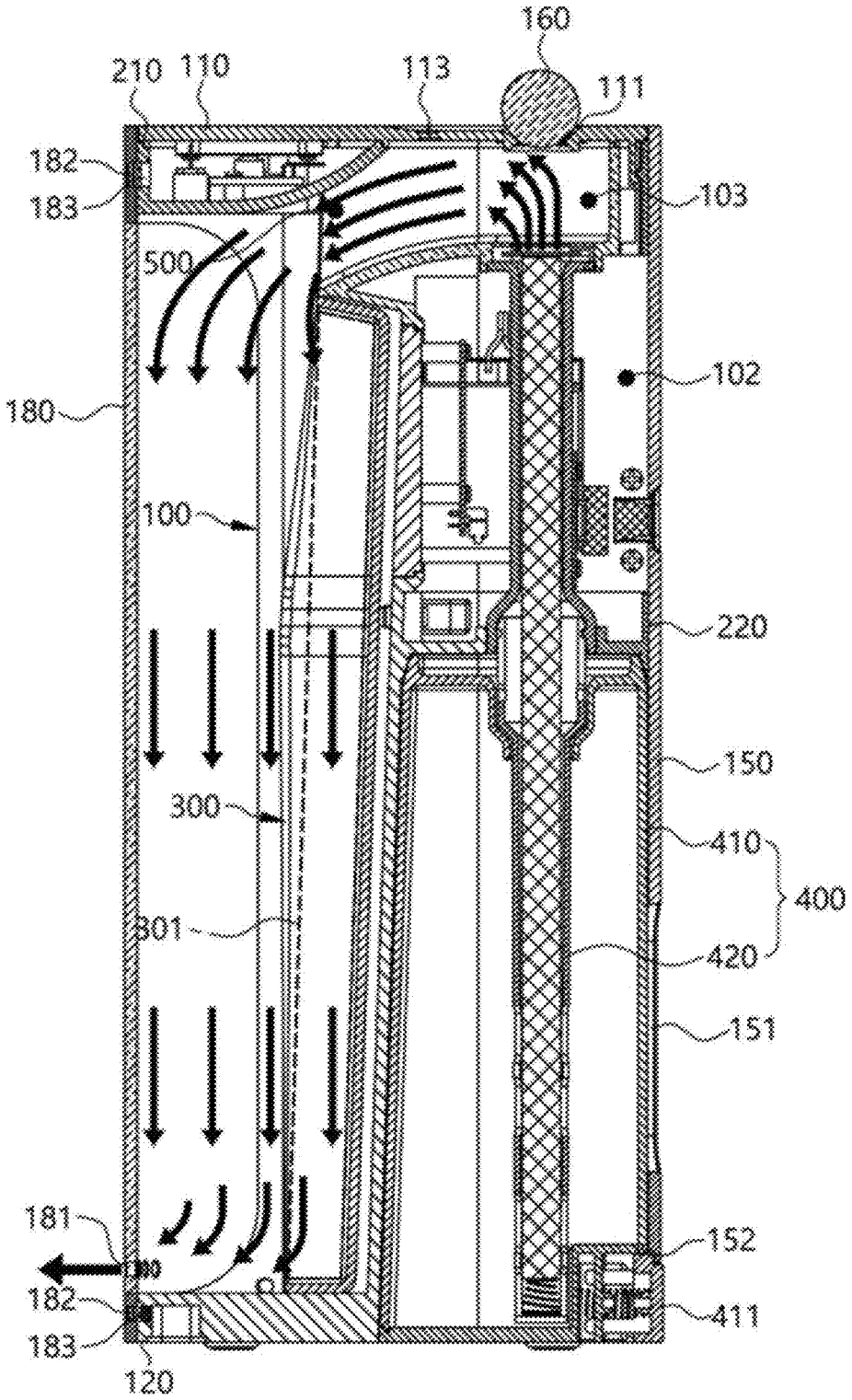

In addition, while the above-described humidification operation is being performed, the user may selectively close the spray hole 111 as illustrated in FIG. 11 attached.

That is, the user may close the spray hole 111 using the opening/closing member 160. In this way, the detection sensor 170 detects when the spray hole 111 is closed by the opening/closing member 160, and the controller checks the detection of the detection sensor 170.

Accordingly, the controller controls the operation of the lamp 214 and/or the humidifier 400 based on the information detected by the detection sensor 170.

For example, when the controller confirms that the spray hole 111 is closed using the detection sensor 170, the controller may control the lamp 214 to emit light. As a result, moisture and air are provided to the moss, and at the same time, light is provided by the lamp 214, so the moss may perform the photosynthesis.

In addition, when the controller confirms that the spray hole 111 is closed based on the signal received from the detection sensor 170, the controller may control the humidifier 400 to operate for a set time. The set time may be a time under the condition that the moss of the moss panel 301 present in the moss frame 300 is not over-humidified. That is, when the spray hole 111 continues to be closed even if the humidifier 400 operates for the set time, the controller stops the operation of the humidifier 400 to prevent the moss from being over-humidified. As a result, the moss may be prevented from problems such as browning, growth inhibition, or microbial growth due to the over-humidification.

When the spray hole 111 is open before the set time has elapsed, the opening of the spray hole 111 is detected by the detection sensor 170 and then the corresponding signal is provided to the controller. When the open signal of the spray hole 111 is received, the controller controls the humidifier 400 to continuously operate even after the set time has passed. That is, when the spray hole 111 is open, most of the water vapor sprayed into the third space 103 is discharged through the spray hole 111, so the over-humidification of the moss does not occur.

As described above, according to the air purifier with a humidification function of the present disclosure, by performing the function of humidifying the room and selectively providing the water vapor to the moss, it is possible to obtain clean air according to a photosynthetic effect.

In addition, according to the air purifier with a humidification function of the present disclosure, when the water vapor is provided to the moss, the water vapor is controlled to be provided only for the set time, so it is possible to prevent the over-humidification of the moss.

Meanwhile, the air purifier with a humidification function of the present disclosure may be used for the portable purpose. In other words, the air purifier with a humidification function of the present disclosure can be used for the portable purpose by the battery 240.

In particular, the air purifier with a humidification function of the present disclosure may be configured in a small size. In other words, the air purifier with a humidification function of the present disclosure is preferably used for humidifying local areas because it does not use a fan. For example, the air purifier with a humidification function may be used as a personal humidifying device.

In addition, the air purifier with a humidification function of the present disclosure may be implemented in various forms other than those of the above-described exemplary embodiments.

As another exemplary embodiment of the air purifier with a humidification function of the present disclosure, the air purifier with a humidification function of the present disclosure may further include a front cover 180 that covers the open front surface of the body frame 100 as illustrated in FIGS. 12 to 15 attached.

The front cover 180 serves to not only protect the moss of the moss panel 301 accommodated in the moss frame 300 from the external environment, but also block the first space 101 from the external environment. That is, when the spray hole 111 is closed and the water vapor in the third space 103 flows into the first space 101 through the communication passage 500, the water vapor may be provided evenly to the entire area of the moss panel 301 without being discharged directly to the outside by the front cover 180. This is the same as FIG. 15 attached.

In particular, the front cover 180 also serves to further increase the pressure difference between the third space 103 and the first space 101. In other words, since the first space is closed by the front cover 180, when a pressure change occurs in the third space 103, it may be most affected. As a result, the air passing through the moss panel 301 in the first space 101 may be smoothly carried on the water vapor discharged through the spray hole 111. This is the same as FIG. 14 attached.

At least a portion of the front cover 180 is made of a transparent material, so the moss panel 301 planted on the moss frame 300 may be observed from the outside.

The front cover 180 may be configured to be selectively separated. To this end, the corresponding coupling structure may be provided on an opposing surface between the front cover 180 and the body frame 100. For example, a magnetic material (or magnetic member) 182 is provided at the upper end and lower end of the rear surface of the front cover 180, respectively, and another magnetic material (or magnetic member) 183 attached to the magnetic material 180 is provided on the front surface of the upper frame 210 and the front surface of the bottom plate 120.

In addition, an inflow hole 181 for the inflow of indoor air may be formed in the front cover 180. That is, the formation of the inflow hole 181 allows indoor air to flow into the first space 101.

By providing the inflow hole 181, the indoor air flowing into the first space 101 may be purified while passing through the moss and then provided indoors together with the water vapor discharged through the spray hole 111.

In other words, while the water vapor that passes through the humidifying pipe 420, and is sprayed into the third space 103 and discharged into the spray hole 111 passes through the spray hole 111 which is momentarily narrower than the third space 103, the flow speed of the water vapor becomes fast. As the pressure of the third space 103 is rapidly lowered due to this phenomenon, air suction force is provided to the first space 101. Therefore, the air introduced into the first space 101 through the inflow hole 181 flows into the third space 103 due to the pressure difference between the first space 101 and the third space 103, and then is discharged into the spray hole 111 together with the water vapor. In this process, the air that is introduced into the first space 101 and flows into the third space 103 may be purified as it passes through the moss, and then provided indoors together with the water vapor.

In particular, the inflow hole 181 may be formed to be located as far away from the communication passage 500 as possible in each area of the front cover 180. That is, the inflow hole 181 and the communication passage 500 are formed to be located on opposite sides of the first space 101, respectively, so the air introduced into the first space 101 through the inflow hole 181 may pass through the entire area of the moss panel 301 and may then be discharged to the communication passage 500.

Therefore, by the structure of an air purifier with a humidification function according to another exemplary embodiment of the present disclosure, even if a separate fan is not provided to force air flow, it is possible to implement the smooth humidification and air purification of the room.

As another exemplary embodiment of the air purifier with a humidification function of the present disclosure, the air purifier with a humidification function of the present disclosure may be provided with a structure to prevent an oil film that may be generated in the spray hole 111.

That is, in the state where the opening/closing member 160 closes the spray hole 111, the oil film is formed on the spray hole 111 by the water vapor that passes through the humidifying pipe 420 and is sprayed into the third space 103. The oil film formed in this way continues to close the spray hole 111 even if the opening/closing member 160 is separated, preventing the discharge of the water vapor.

Accordingly, while the opening/closing member 160 is blocking the spray hole 111 or when the opening/closing member 160 is separated from the spray hole 111, it is preferable to prevent the oil film from being formed in the spray hole 111 or to allow the oil film formed in the spray hole 111 to be removed.

Considering this, in still another exemplary embodiment of the present disclosure, when the opening/closing member 160 closes the upper end of the spray hole 111, it is presented that a separate opening/closing plate 190 is additionally provided to close the lower end of the spray hole 111.

Figure 16:
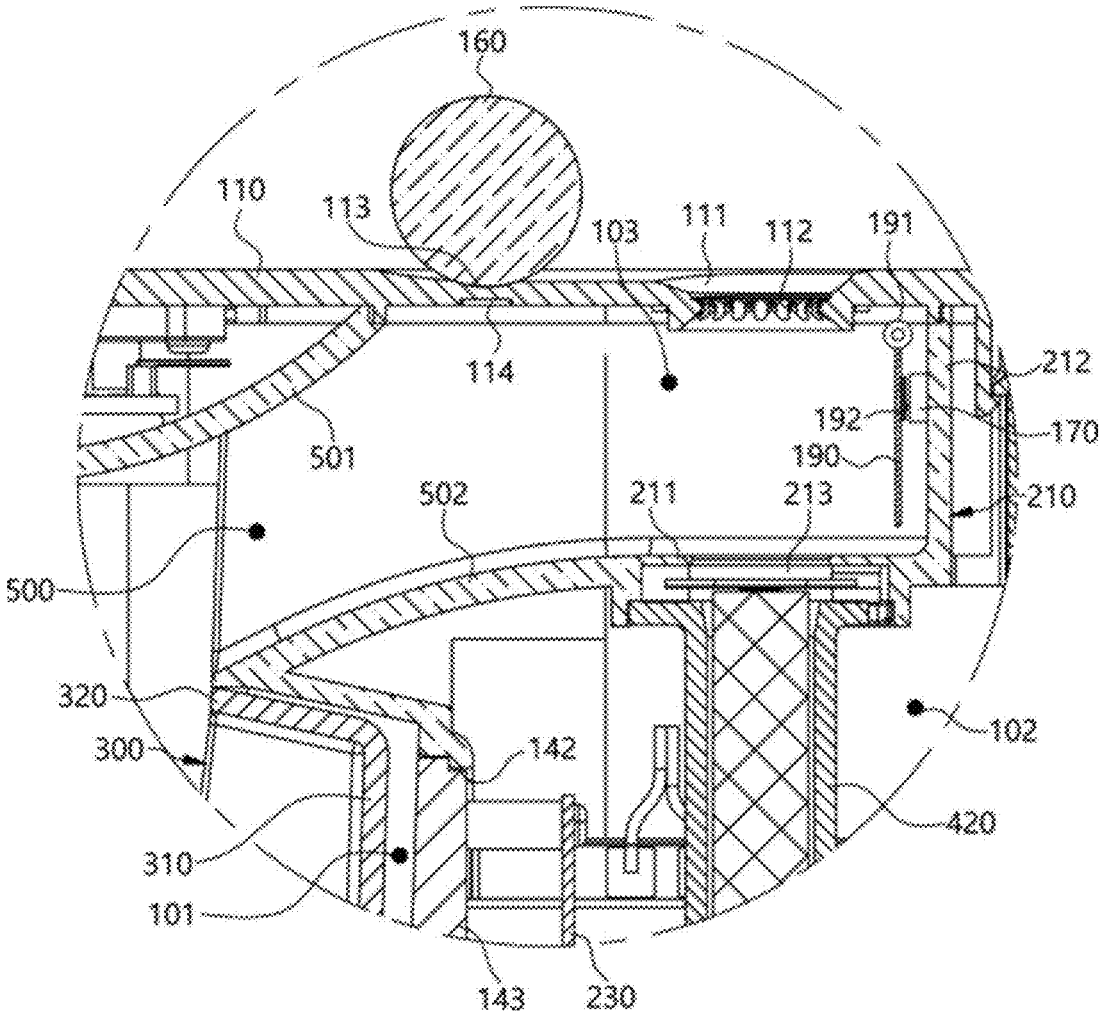
FIGS. 16 and 17 are state diagrams of the air purifier with a humidification function according to still another exemplary embodiment of the present disclosure.
Figure 17:
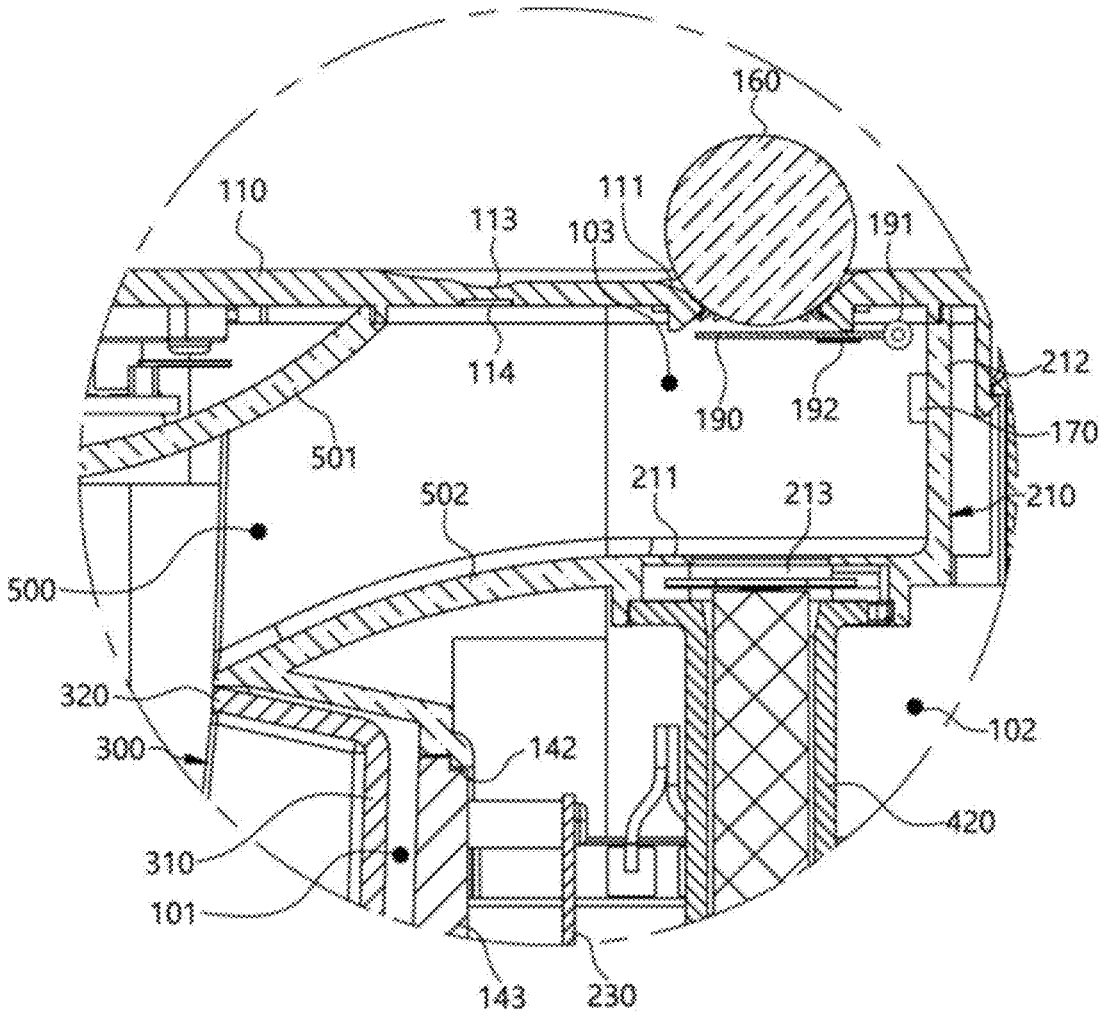

That is, as illustrated in FIGS. 16 and 17 attached, the opening/closing plate 190 selectively closes the lower end of the spray hole 111, thereby preventing the oil film from being generated as the water vapor accumulates in the contact area between the spray hole 111 and the opening/closing member 160.

Of course, the oil film may be prevented by forming the irregularities 112 along the inner peripheral surface of the spray hole 111. However, when moisture accumulates in the contact area between the opening/closing member 160 and the spray hole 111, since there is a risk of the oil film being generated even if the irregularities 112 are present, the opening/closing plate 190 for covering at least portion of the spray hole 111 is additionally provided, thereby preventing the occurrence of the oil film due to the opening/closing member 160.

The opening/closing plate 190 is connected to the body frame 100 or the upper plate 110 by a connection part 191 so that it may open the lower end of the spray hole 111 and may be positioned adjacent to the spray hole 111 when being separated from the opening/closing member 160. In this case, the connection part 191 may be composed of a hinge that supports the opening/closing plate 190 to rotate, or may be composed of a thin film connecting the opening/closing plate 190 and the body frame 100 or the upper plate 110.

On the other hand, when the opening/closing plate 190 is formed to completely cover the spray hole 111, there may be cases where the opening/closing plate 190 is not open even if the opening/closing member 160 is open due to the surface tension of moisture remaining between the opening/closing plate 190 and the spray hole 111.

In consideration of this, as illustrated in FIG. 17 attached, the opening/closing plate 190 may be formed to have a length enough to partially open the spray hole 111 without completely covering the spray hole 111. Although not illustrated, protrusions may be formed on the surface of the opening/closing plate 190 to prevent the opening/closing plate 190 from being completely adhered to the spray hole 111, or protrusions may be formed on the floor area of the spray hole 111 to prevent the opening/closing plate 190 from completely adhering to the spray hole 111.

In addition, the opening/closing plate 190 itself may be formed of a steel plate or a magnetic material that may be attached to the opening/closing member 160. However, when the opening/closing plate 190 is made of a steel plate, a problem may occur where the opening/closing plate 190 has magnetism and does not move easily when attached to the spray hole 111 for a long time. For example, when the opening/closing plate 190 made of a steel plate is attached to the opening/closing member 160 for a long time and has magnetism, the opening/closing plate 190 may remain continuously attached due to the influence of the magnetic member 114 provided to the upper plate 110 or the influence of the opening/closing member 160 stored in the storage groove 113 even if the opening/closing member 160 is removed.

Considering this, the opening/closing plate 190 may be formed of a non-magnetic material, and an attachment member 192 made of a magnetic material may be additionally provided on at least a portion of the opening/closing plate 190. This may prevent the phenomenon in which the opening/closing plate 190 is magnetized and remains attached to the spray hole 111, and when the opening/closing member 160 is located in the spray hole 111, the opening/closing plate 190 may be moved to a location where it covers the spray hole 111. The attachment member 192 may be located adjacent to the hinge to accurately receive the influence of the opening/closing member 160.

In addition, when the opening/closing plate 190 is formed of a non-magnetic material, the detection sensor 170 may be configured to detect whether the spray hole 111 is closed based on whether the attachment member 192 is adjacent. For example, when the attachment member 192 is formed as a magnet and the attachment member 192 is adjacent to the detection sensor 170, it may be determined that the spray hole 111 is open, and when the attachment member 192 is far away from the detection sensor 170, it may be determined that the spray hole 111 is closed.

As such, the air purifier with a humidification function of the present disclosure may be modified or implemented in various forms.

Although it has been described that all components configuring the exemplary embodiment of the present disclosure are combined with each other as one component or are combined and operated with each other as one component, the present disclosure is not necessarily limited to the abovementioned exemplary embodiment. That is, all the components may also be selectively combined and operated with each other as one or more components without departing from the scope of the present disclosure. In addition, hereinabove, the terms "include", "configure", "have", or the like, are to be interpreted to imply the inclusion of other components rather than the exclusion of other components, since they mean that a corresponding component may be included unless particularly described otherwise. Unless defined otherwise, all the terms including technical and scientific terms have the same meaning as meanings generally understood by those skilled in the art to which the present disclosure pertains. Generally used terms such as terms defined in a dictionary should be interpreted as the same meanings as meanings within a context of the related art and should not be interpreted as ideally or excessively formal meanings unless clearly defined in the present disclosure.

The spirit of the present disclosure has been illustratively described hereinabove, and those skilled in the art to which the present disclosure pertains may make various modifications and alterations without departing from the essential characteristics of the present disclosure. Accordingly, exemplary embodiments disclosed in the present disclosure are not to limit the spirit of the present disclosure, but are to describe the spirit of the present disclosure. The scope of the present disclosure is not limited to these exemplary embodiments. The scope of the present disclosure is to be interpreted by the following claims, and it is to be interpreted that all the spirits equivalent to the following claims fall within the scope of the present disclosure.

What is claimed is:

1. An air purifier with a humidification function, comprising:

a body frame having a partition wall that partitions a first space at a front thereof and a second space at a rear thereof, an upper plate that is provided with a spray hole while forming an upper surface, and a bottom plate that forms a bottom surface;

an upper frame protruding from a rear surface of the partition wall and forming a third space between an upper portion of the second space and the upper plate;

a moss frame installed in the first space of the body frame and accommodating a moss panel;

a humidifier installed in the second space of the body frame, generating water vapor, and discharging the generated water vapor toward the spray hole while passing through the third space; and a communication passage formed to communicate between the first space and the third space, wherein the humidifier includes a water tank that is installed in the second space of the body frame, and a humidifying pipe that includes an inlet located within the water tank and an outlet located to discharge the water vapor toward the spray hole of the upper plate through a floor of the upper frame.

2. The air purifier according to claim 1, wherein the upper plate of the body frame is further provided with an opening/closing member that opens and closes the spray hole.

3. The air purifier according to claim 2, wherein the opening/closing member is made of a magnetic material that has its own magnetic force.

4. The air purifier according to claim 3, wherein the spray hole is further provided with an opening/closing plate that operates to close the spray hole by the magnetic force of the opening/closing member when being adjacent to the opening/closing member.

5. The air purifier according to claim 1, wherein the body frame further includes a detection sensor detecting whether the spray hole is closed, and a controller controlling an operation of the humidifier based on information detected by the detection sensor.

6. The air purifier according to claim 1, wherein the upper frame is provided with a discharge hole that matches the outlet of the humidifying pipe and has the water vapor discharged therethrough, and the upper frame is located to be spaced apart from the upper plate so that the discharge hole is spaced apart from the spray hole.

7. The air purifier according to claim 1, wherein the first space is formed to be partitioned from an external environment by a front cover, and the front cover is provided with an inflow hole through which indoor air is introduced.

8. The air purifier according to claim 7, wherein the inflow hole and the communication passage are each located on opposite sides of the first space.

9. The air purifier according to claim 1, wherein the moss frame has a rear wall surface on which the moss panel is seated and a circumferential wall surface provided along a circumference of the rear wall surface, and at least one area of the circumferential wall surface is formed to protrude toward the moss panel for gripping the moss panel.

10. An air purifier with a humidification function, comprising:

a body frame having a first space that has an upper surface on which a spray hole is formed and is provided with a moss panel, a second space in which a humidifier is installed, and a third space that is formed to communicate with the first space and through which water vapor generated from the humidifier passes therethrough before being sprayed into the spray hole;

an opening/closing member provided to selectively close the spray hole;

a detection sensor detecting whether the spray hole is closed by the opening/closing member; and a controller receiving detection information on whether the spray hole is closed from the detection sensor and controlling an operation of the humidifier, wherein an upper plate is provided with the spray hole while forming the upper surface, wherein the upper plate of the body frame is further provided with the opening/closing member that opens and closes the spray hole, and wherein the opening/closing member is made of a magnetic material that has its own magnetic force.

11. The air purifier according to claim 10, wherein the controller is configured to operate the humidifier only for a set time when the spray hole is closed.

12. An air purifier with a humidification function, comprising:

a body frame having a partition wall that partitions a first space at a front thereof and a second space at a rear thereof, an upper plate that is provided with a spray hole while forming an upper surface, and a bottom plate that forms a bottom surface;

an upper frame protruding from a rear surface of the partition wall and forming a third space between an upper portion of the second space and the upper plate;

a moss frame installed in the first space of the body frame and accommodating a moss panel;

a humidifier installed in the second space of the body frame, generating water vapor, and discharging the generated water vapor toward the spray hole while passing through the third space; and a communication passage formed to communicate between the first space and the third space, wherein the moss frame has a rear wall surface on which the moss panel is seated and a circumferential wall surface provided along a circumference of the rear wall surface, and at least one area of the circumferential wall surface is formed to protrude toward the moss panel for gripping the moss panel.

* * * * *